United States Patent [19]

Riehle

[11] Patent Number: 4,569,157

[45] Date of Patent: Feb. 11, 1986

[54] FLAGGING APPARATUS AND MACHINE EQUIPPED THEREWITH

[75] Inventor: Dennis R. Riehle, Cincinnati, Ohio

[73] Assignee: Cincinnati Milacron Inc., Cincinnati, Ohio

[21] Appl. No.: 685,694

[22] Filed: Dec. 24, 1984

[51] Int. Cl.[4] ..... B24B 49/10

[52] U.S. Cl. ..... 51/165.75; 51/105 SP

[58] Field of Search ..... 51/165 R, 165.74, 165.75, 51/165.76, 105 SP

[56] References Cited

U.S. PATENT DOCUMENTS

| | | | |
|---|---|---|---|
| 2,342,854 | 2/1944 | Garside | 51/165.75 |
| 2,528,295 | 10/1950 | Balsiger et al. | 51/165 |
| 2,559,431 | 7/1951 | Hollengreen | 51/165.75 |
| 3,145,508 | 8/1964 | Price | 51/105 |
| 3,763,600 | 10/1973 | Shank | 51/105 S |
| 3,855,734 | 12/1974 | Fournier | 51/165 R |

OTHER PUBLICATIONS

Precision–Balluff—Inductive Proximity Switches Bulletin.

*Primary Examiner*—Harold D. Whitehead
*Attorney, Agent, or Firm*—Donald Dunn

[57] ABSTRACT

A flagging apparatus having non-contacting proximity switches emitting a directional energy field and producing a signal in response to an induced alteration of the energy field, a rotatable target element having target faces for engaging and altering the energy field and a probe attached to the target element and contacted by a surface of a workpiece is provided for repetitively positioning workpieces in the work space of a grinder in reference to a grinding wheel. Advantageously, the flagging apparatus is operative in either of two opposing directions without a mechanical and/or electrical change over or modification in the apparatus with a change in operating direction. To achieve the operation in either of two opposing directions the target faces of the target element are spaced apart from each other such that the sequence in which the energy fields are engaged and altered by the target faces remains independent of the direction of rotation of the target element.

9 Claims, 12 Drawing Figures

FLAGGING APPARATUS AND MACHINE EQUIPPED THEREWITH

FIELD OF INVENTION

This invention generally relates to flagging devices for the positioning of a workpiece in a work space and to machines having a flagging device. More particularly this invention relates to flagging devices for the repetitive positioning of metallic workpieces in the work space of a machine tool (e.g. grinding machine) for the removal of metal (e.g. grinding) from the workpiece.

BACKGROUND

Flagging devices of various types have been known and used in the metalworking art, particularly the metal grinding art, for some time. A flagging device is an apparatus attached to a machine tool in a fixed position relative to the work space and having a probe extending into the work space to establish a location in the work space to which a reference surface of a workpiece is brought relative to a tool for shaping the workpiece (e.g. a grinding wheel for grinding a metallic workpiece). Among the flagging devices that have been used in the art are those having a probe linked to a dial gage fixed to the machine. The reference surface is brought into contact with the probe, usually manually, and displaces the probe slightly until the needle on the dial gage registers a fixed predetermined value (e.g. zero). This type of flagging device is usually employed with a manually operated machine tool to move the workpiece into position for shaping by a tool. Other flagging devices used in the art employ a probe extending into the work space of a machine tool, that engages mechanically operated electrical switches. In such devices the probe is contacted and slightly displaced by the reference surface of a supported workpiece that has been moved into the probe contacting position by a power driven workpiece carrying member of the machine tool, e.g. machine tool table or movable headstock. The displaced probe manipulates a mechanically operated electrical switch to cause the termination of the linear movement of the workpiece in the work space and thereby positions the workpiece in the work space for engagement by a tool to subsequently shape the workpiece (e.g. by grinding).

Some flagging devices in the art are fixed with respect to the direction of approach of and contact by the reference surface on the probe. Thus the approach may be from the left to the probe, left flagging, or from the right to the probe, right flagging. Still other flagging devices in the art may be switched from one flagging direction (e.g. left flagging) to the opposite flagging direction (e.g. right flagging). Such changes in flagging direction have involved mechanical and/or electrical rearrangements in the flagging device.

Advantageously flagging devices are used in production set ups to reproducably position workpieces of the same shape in a work space of a machine tool for the same shaping operation (e.g. grinding of shoulders or flanges). Although being advantageous for the reproducable positioning of workpieces in the work space of a machine tool, flagging devices using mechanically operated electrical switches are known to be troublesome because the moving mechanical elements of the switch are susceptible to rapid wear and malfunction and the switch is very difficult to seal against liquids, dirt and metal particles from the metal working operation. Such wear and sealing problems result in switch malfunctions and leads to a short life time for the switch and hence to failures and poor performance of the flagging device. Failure or poor operation of the flagging device often leads to machine wrecks where the tool (e.g. grinding wheel) advances to engage the workpiece at a wrong position on the workpiece. It is therefore highly desirable to have a flagging device which overcomes such difficulties and deficiencies.

It is the general object of this invention to provide a bidirectional, reliable, durable flagging apparatus, for positioning a workpiece in a machine tool work space with respect to a tool, that is highly resistant to switch malfunctions due to mechanical deterioration of the switch and the failure of a sealing means for protecting the switch against penetration by liquids, dirt and metal particles. A further object of this invention is to provide a flagging apparatus that is operable in either of two opposing directions for positioning a workpiece in a machine tool work space without the mechanical and/or electrical alteration of the flagging apparatus being required.

SUMMARY OF THE INVENTION

There is now provided in accordance with this invention a flagging apparatus, operable in either of two opposing directions without a required mechanical and/or electrical change over or modification of the apparatus with a change of operating directions, for positioning a workpiece in the work space of a machine tool and that may be readily made durably resistant to electrical malfunctions caused by contact of the apparatus with liquids during the shaping of the workpiece. The flagging apparatus according to this invention comprises at least one non-contacting non-mechanical proximity switch for indicating the presence of the workpiece in a predetermined position in the work space of a machine tool said switch emitting a directional energy field and producing a signal in response to an externally induced change in the energy field, a target element movable in either of two opposing directions along a path through the energy field having at least two target faces interactive with the energy field to induce a change in the field said target faces spaced apart from each other in a constant field interactive sequence relation and a probe attached to the target element for engaging the workpiece. In the practice of this invention the directional energy field is directed toward the target element that is moved by the workpiece contacting and displacing slightly the probe attached to the target element. Movement of the target element causes the target faces to interact with the energy field producing a change in the field that results in a signal being produced by the switch. This signal in turn is used to control the movement of the workpiece in the work space through controlling the workpiece moving member of the machine tool.

DETAILED DESCRIPTION OF THE INVENTION

Figure 1:
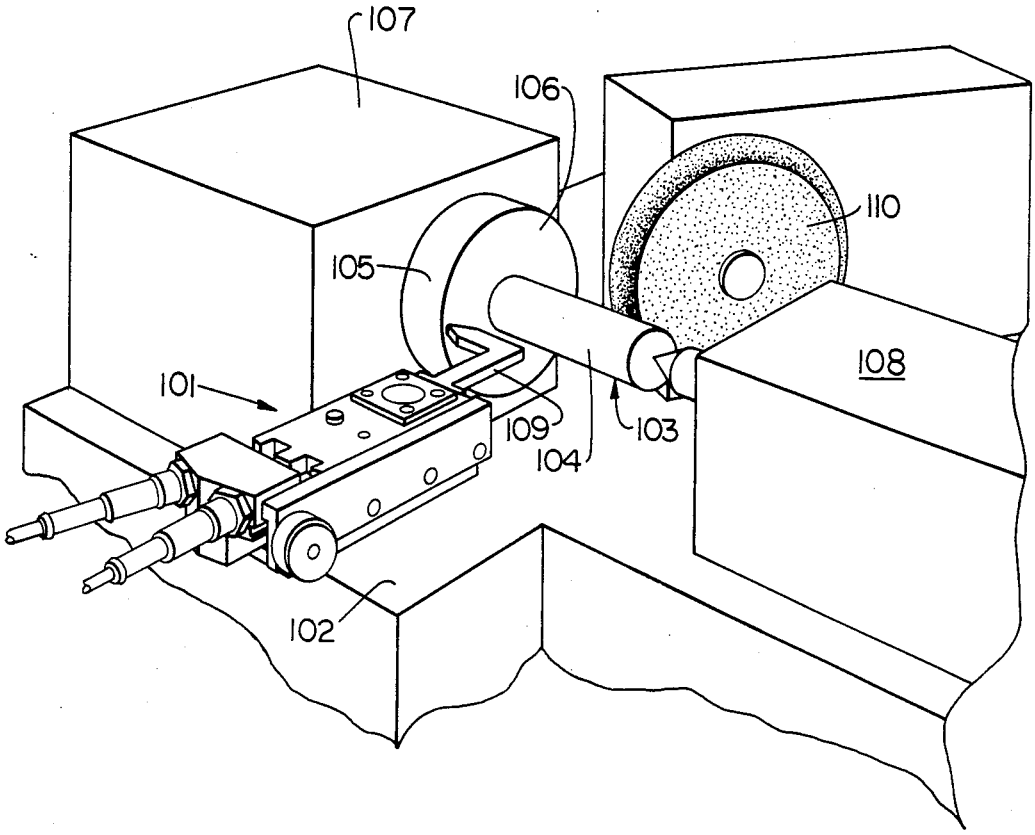
FIG. 1 is a partial isometric view of a grinding machine showing the relative positions of the flagging apparatus, the workpiece and the grinding wheel.
Figure 4A:
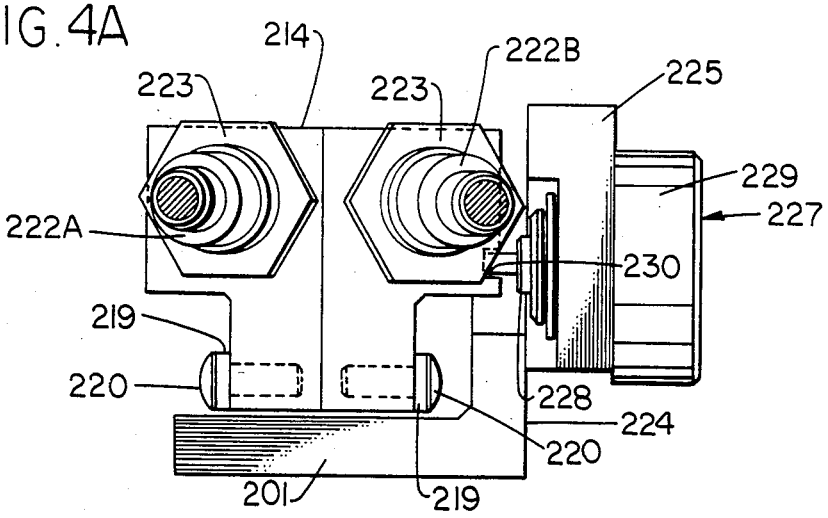
FIG. 4A is an end view of the flagging apparatus taken along line 4A—4A of FIG. 3.

The flagging apparatus according to this invention will now be described in further detail in respect to a preferred embodiment of the invention with reference to the drawings. There is schematically shown, in partial isometric view, in FIG. 1 the flagging apparatus of this invention in one working arrangement in which the flagging apparatus 101 is attached to mount 102, which may be a fixed or movable mount, connected to a non-movable member of a grinding machine (e.g. base) not shown. Workpiece 103 (e.g. a metal workpiece) having a shank portion 104 and a flange portion 105 with reference surface 106 is mounted between headstock 107 and footstock 108. Headstock 107 and footstock 108 are attached to a movable table (not shown) of the grinding machine and move longitudinally with the movement of the table thus longitudinally moving workpiece 103. The flagging apparatus 101 has a probe 109 extending into the work space between headstock 107 and footstock 108 and terminating in a tip positioned in a predetermined location within the work space in respect to the grinding wheel 110. Reference surface 106 is moved longitudinally toward probe 109 by longitudinal movement of the grinding machine table and hence headstock 107 and footstock 108 carrying workpiece 103. It is of course recognized that other arrangements for moving the workpiece may be used. For example, the workpiece may be mounted between a headstock and a footstock that are fixed in position on the grinding machine and wherein the headstock has a driven, horizontally movable headstock center engaging the workpiece and moving the workpiece horizontally against a spring loaded, horizontally movable footstock center.

Figure 2:
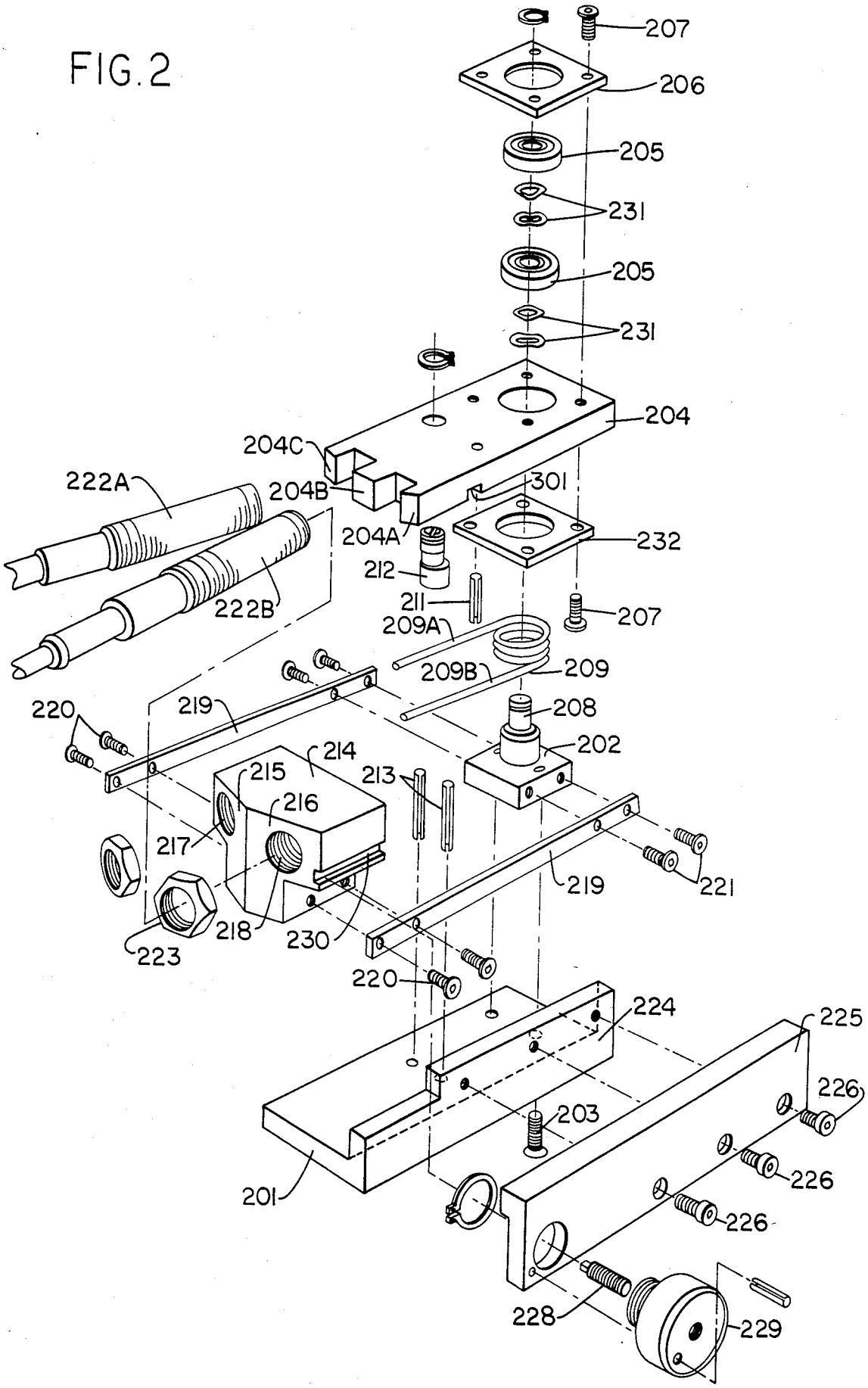
FIG. 2 is an exploded view of a flagging apparatus.
Figure 3:
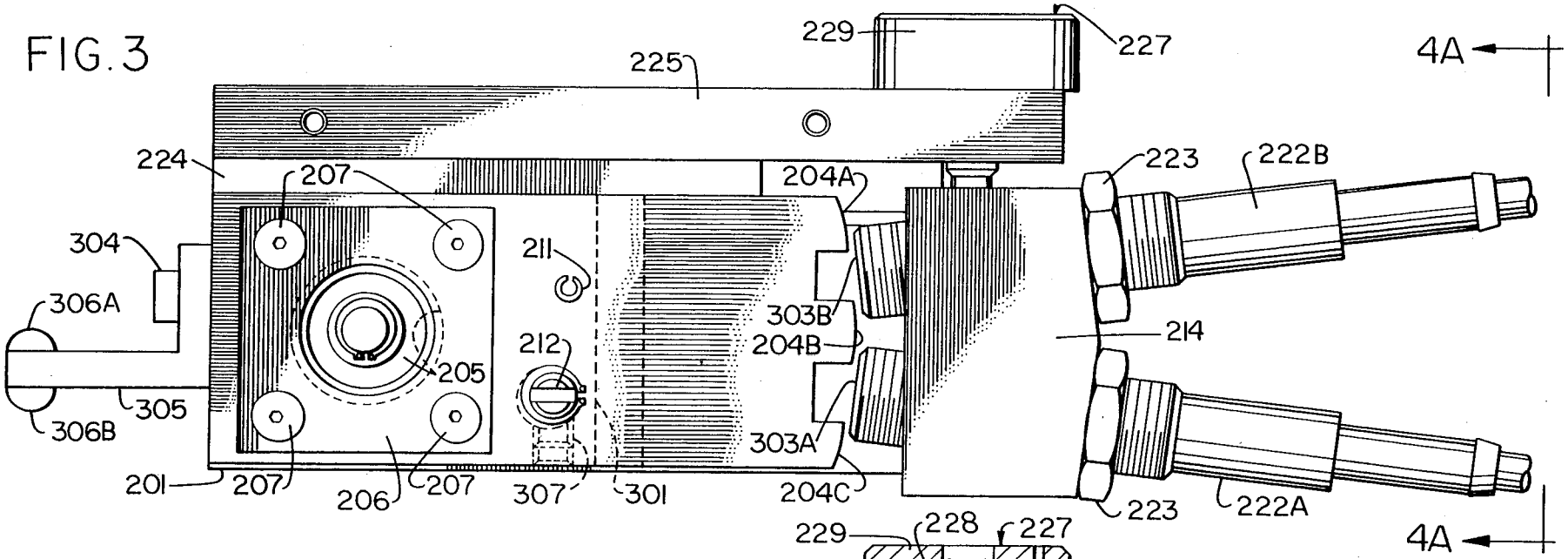
FIG. 3 shows a top view of the assembled flagging apparatus shown in FIG. 1.
Figure 3A:
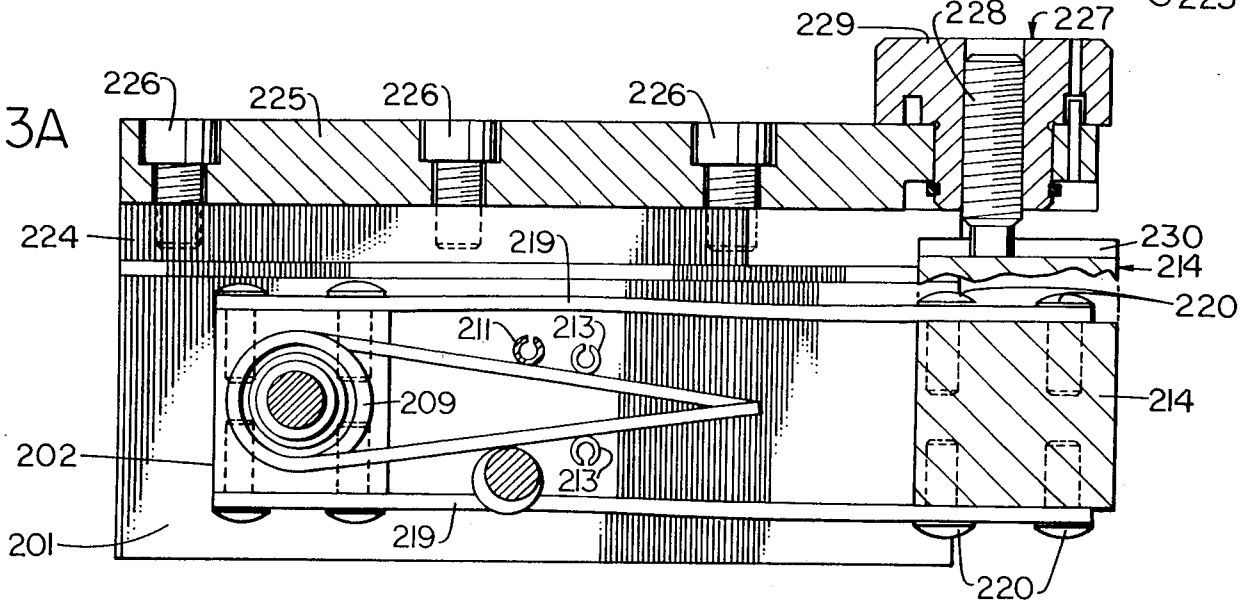
FIG. 3A is a plan section of the flagging apparatus taken along line 3A—3A of FIG. 4.
Figure 4:
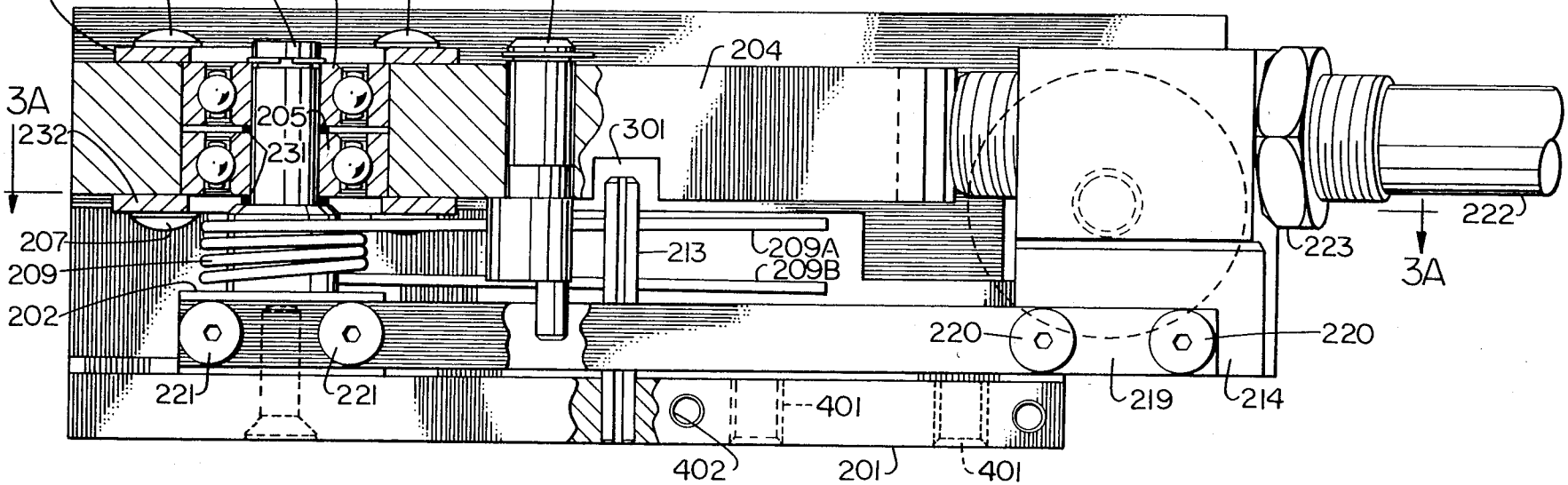
FIG. 4 is a side elevation view of the assembled flagging apparatus of FIG. 1.

In a preferred embodiment of this invention shown in an exploded view in FIG. 2, a top view in FIG. 3, and a side view in FIG. 4, a base 201 carries a block 202 attached to a base 201 by bolts 203. A movable target element 204 having target faces 204A, 204B and 204C, for non-contact engaging and interacting with an energy field, is rotatably supported, via bearings 205 preloaded by wavy spacer springs 231 in the rear of target element 204 and held by plates 206 and 232 and bolts 207, on a shaft 208, carrying coil spring 209 having arms 209A and 209B. Coil springs arms 209A and 209B engaging pins 211 and 212 extending from the bottom of target element 204 and pins 213 inserted into base 201 bias the target element 204 to return to a central neutral position from a rotationally displaced position. Pin 211 is stationary and engages one arm of coil spring 209 while pin 212 having an eccentric portion engaging the other arm of coil spring 209 is rotatable via slot 302 and lockable by set screw 307 to bring target element 204 under the tension of spring 209 in the target element's central neutral position. Pins 213 are used to preload coil spring 209 and extend upwards from base 201 into groove 301 in target element 204 so that coil spring arms 209A and 209B are retained by pins 213. A proximity switch block 214 having two faces 215 and 216 forming an obtuse angle between them and each having threaded switch receiving holes 217 and 218 respectively centrally located in each face with the longitudinal axis of the hole normal to the face. Holes 217 and 218 extend through block 214 to the opposite side to exit on a face of block 214 confronting target faces 204A, 204B and 204C. Block 214 is supported by two leaf springs 219 attached at one end on the opposite sides of block 214 by bolts 220 and at the other end on opposite sides of block 202 by bolts 221. Thus switch block 214 is movable horizontally in two directions with a spring powered return to a center position. Inductive proximity switches 222A and 222B having surfaces 303A and 303B respectively, emitting an induced alternating radio frequency field in a direction toward the movable target element 204 are threadably mounted in each of holes 217 and 218, respectively, of switch block 214 with the radio frequency field emitting surfaces extending out of switch block 214 to a short distance from the target face end of target element 204. Each proximity switch is locked in position in switch block 214 by nut 223. The radio frequency field emitting surfaces of the two inductive proximity switches form an angle equal to the angle formed between faces 215 and 216 of switch block 214. Base 201 has a vertically rising side 224 to which is bolted side bar 225 by bolts 226 for carrying adjusting screw 227 having screw shaft 228 engaging slot 230 in switch block 214 and knob 229. Adjusting screw 227 moves switch block 214 horizontally. Attached to the end of target element nearest bearing 205 by bolt 304 is probe 305 hemispherical tips 306A and 306B for contacting a reference surface of a workpiece in either direction.

Figure 5:
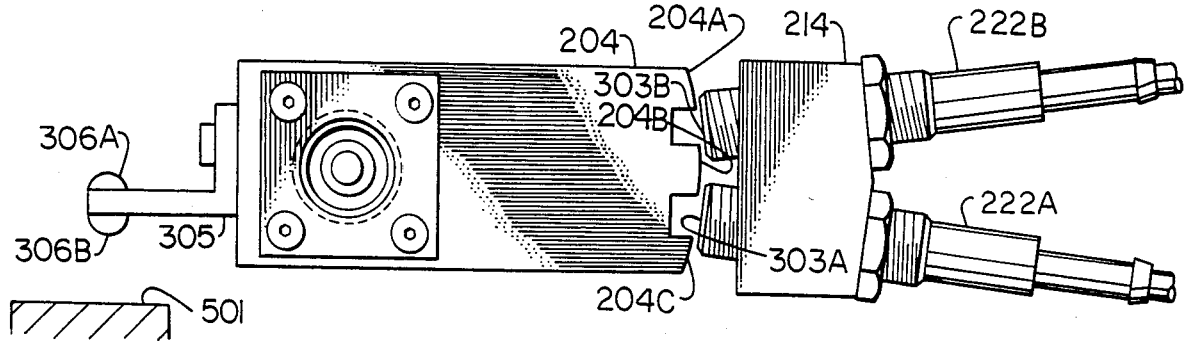
FIG. 5 shows schematically the neutral position of the target element in relation to the proximity switches for the flagging apparatus of FIG. 1.
Figure 6:
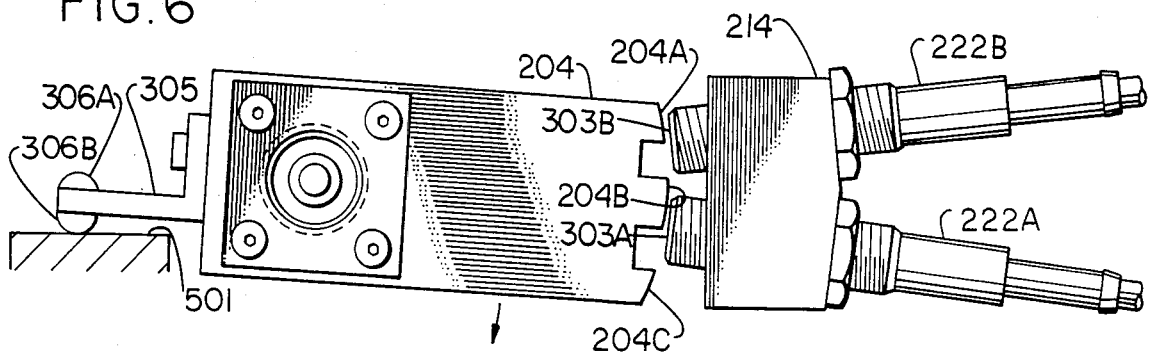
FIG. 6 shows schematically the flag left position of the target element in relation to the proximity switches for the flagging apparatus of FIG. 1.
Figure 7:
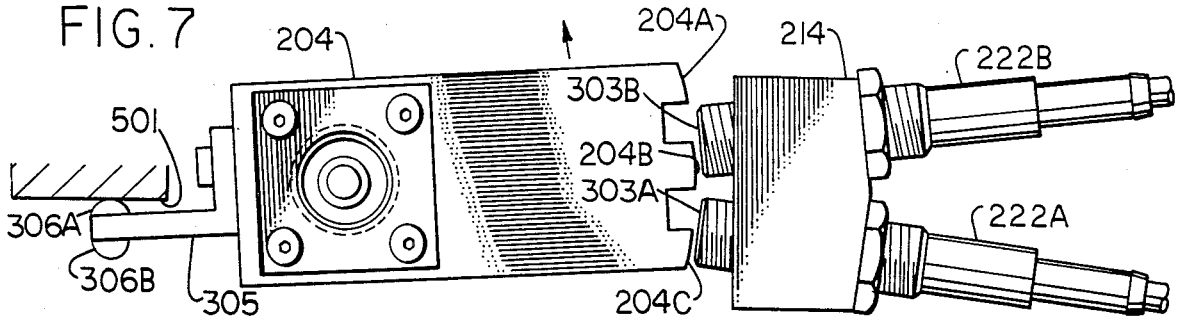
FIG. 7 shows schematically the flag right position of the target element in relation to the proximity switches for the flagging apparatus of FIG. 1.

Referring now to FIGS. 5, 6, and 7 there is schematically shown the advantageous operation of the target element 204, of the flagging apparatus of this invention, in either of two opposing directions without a required mechanical and/or electrical change over or modification of the flagging apparatus that will be discussed in connection with a grinder having a traveling table on which the workpiece is mounted for longitudinal movement (not shown). In this type of grinder the table is customarily used to longitudinally move the workpiece into a predetermined location for engagement by the grinding wheel. Usually, the table carrying the workpiece is rapidly traversed to move the workpiece to a point near the final location of the workpiece in the work space for engagement by the grinding wheel. At this point the traversing speed of the table is reduced to a relatively low value for the final approach of the workpiece to its predetermined final location in the work space. The rapid traverse speed reduces the time to bring the workpiece to its desired predetermined location in the work space and the slow final approach traversing speed minimizes or prevents overshoot of the predetermined location in the work space. The target element 204 of the flagging apparatus of this invention is normally in a central neutral position as shown in FIG. 5 with target faces 204A, 204B and 204C out of engagement with the induced alternating radio frequency fields emitted by surfaces 303A and 303B of inductive proximity switches 222A and 222B respectively. In this normal position tips 306A and 306B on probe 305 attached to target element 204 is not contacted by reference surface 501 of the workpiece (not shown). In FIG. 5 reference surface 501 is shown on the 306B tip side of probe 305, however, it is equally possible to have reference surface 501 on the 306A tip side of probe 305. For purposes of simplicity in showing the motion of target element 204 and target faces 204A, 204B and 204C in relation to the inductive proximity switches 222A and 222B and their surfaces 303A and 303B respectively, and the movement of probe 305 in the operation of the flagging apparatus according to this invention as shown in FIGS. 2, 3, and 4 the remaining parts of the flagging apparatus have been omitted from FIGS. 5, 6, and 7. Reference surface 501 may approach probe 305 from the left, facing into the work space from the direction of the probe as one mode or direction of operation of the flagging apparatus. As reference surface 501 contacts tip 306B and moves further to the right, it rotationally displaces probe 305 and rotates target element 204 as shown in FIG. 6. The rotation of target element 204 in turn displaces target faces 204A, 204B and 204C along a curved path so that the leading edge target face 204A is first brought into interrupting engagement with the induced alternating radio frequency field emitted by surface 303B of switch 222B and subsequently the leading edge of target face 204B is brought into second interrupting engagement with the induced alternating radio frequency field emitted by surface 303A of inductive proximity switch 222A. In this direction of operation target face 204C does not engage an inductive alternating radio frequency field. Target faces 204A, 204B and 204C are spaced apart from each other a distance that causes the induced alternating radio frequency field emitted by surface 303B of switch 222B to be interrupted before the induced alternating radio frequency field emitted by surface 303A of switch 222A is interrupted by the rotation of target element 204 in either direction thus causing switch 222B to generate a signal prior to switch 222A producing a signal. Thus, the sequence of operation of switches 222A and 222B is independent of the direction of rotation of target element 204. The first signal generated by switch 222B in response to the interruption of the induced alternating radio frequency field emitted by surface 303B by the leading edge of target face 204A is employed to reduce the traversing speed of the table of the grinder to some preset low speed for the final approach of the workpiece to the predetermined location in the work space. The second signal generated by switch 222A, after the signal produced by switch 222B, in response to the interruption of the induced alternating radio frequency field emitted by surface 303A is employed to stop the travel of the table and thus the workpiece thereby putting the workpiece at its predetermined location in the work space for engagement by the grinding wheel.

In FIG. 7 reference surface 501 approaches probe 305 from the right, looking into the work space from the probe direction, to illustrate the opposite mode or direction of operation from that of FIG. 6 for the flagging apparatus. As reference surface 501 contacts tip 306A and moves further to the left it displaces probe 305 which in turn rotates target element 204. Rotation of target element 204 moves target faces 204A, 204B and 204C along a curved path in front of switches 222A and 222B that first brings the leading edge of target face 204B into interrupting engagement with the induced alternating radio frequency field emitted by surface 303B of inductive proximity switch 222B and subsequently brings the leading edge of target face 204C into interrupting engagement with the induced alternating radio frequency field emitted by surface 303A of inductive proximity switch 222A. Target face 204A has no field interrupting function in this direction or mode of operation of the flagging apparatus. The signals generated by switches 222A and 222B in response to the interruption of their radio frequency field in the mode of operation shown in FIG. 7 are employed in the same manner for the same purpose as indicated above in respect to the mode of operation of the flagging apparatus as shown in FIG. 6 to accomplish the same result. Thus, switches 222A and 222B perform the same function in both directions of rotation of the target element 204 and no mechanical and/or electrical change over or modification of the flagging apparatus is required with the change in flagging direction.

Figure 8:
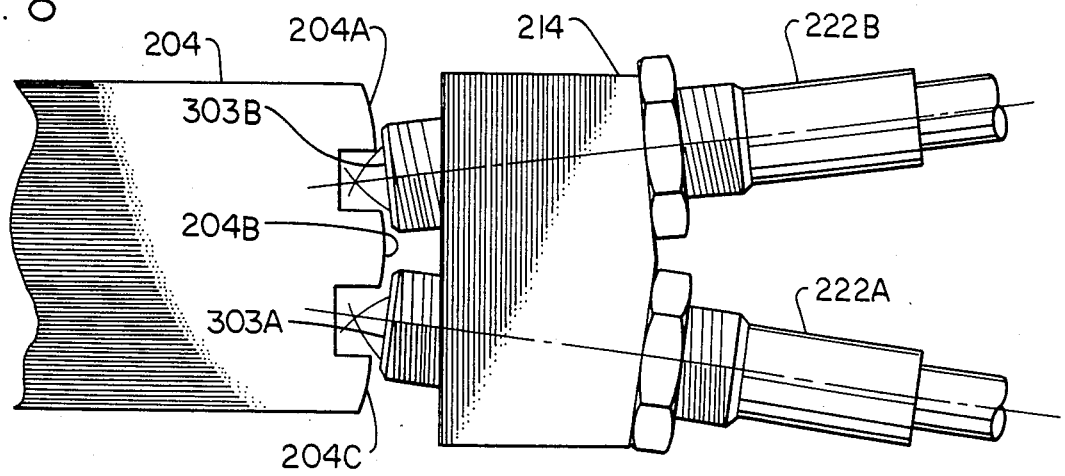
FIG. 8 shows schematically the neutral position of the target element of the flagging apparatus of FIG. 1 with the target faces not interacting with the energy fields of the proximity switches.
Figure 9:
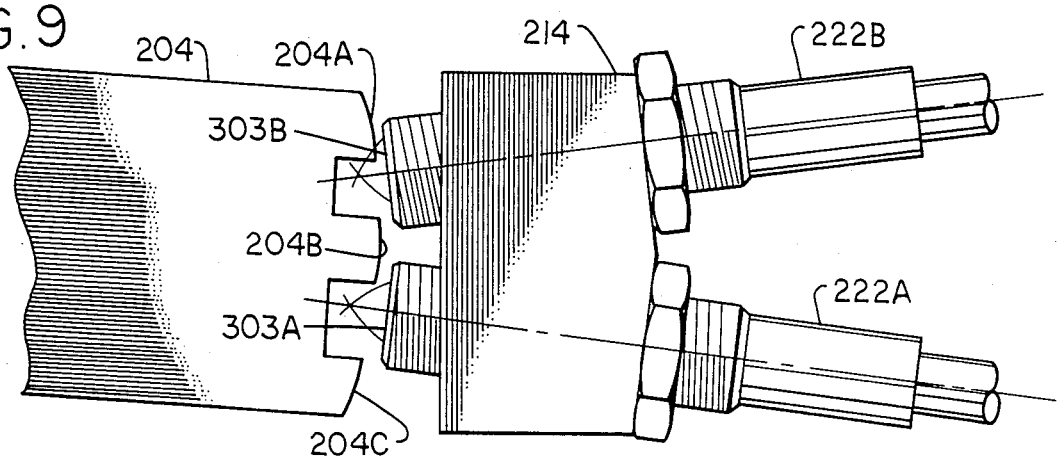
FIG. 9 shows schematically the target element of the flagging apparatus of FIG. 1 in a slightly moved (i.e. rotated) position to have one target face interacting with the energy field of one of the proximity switches.
Figure 10:
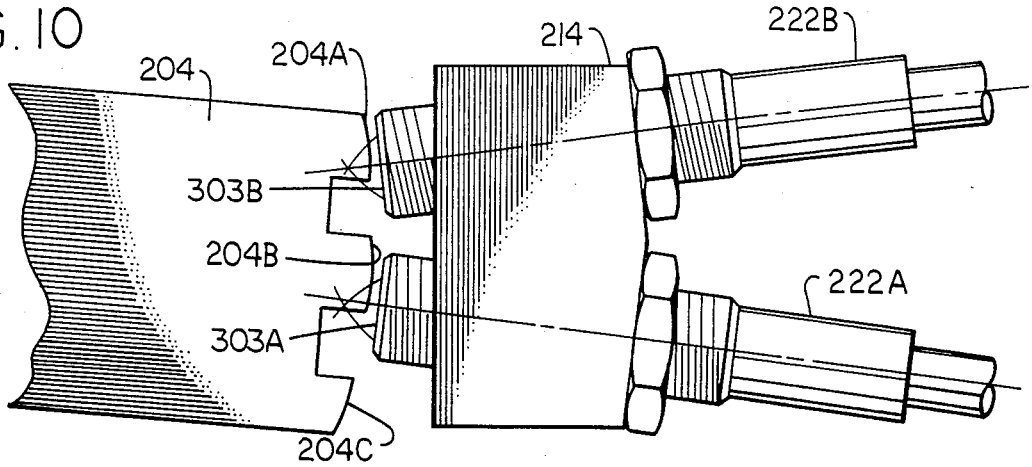
FIG. 10 shows schematically the target element of the flagging apparatus of FIG. 1 in a further rotated position to have the target faces of the target element interacting with the energy fields of both proximity switches.

The operation of target element 204 and target faces 204A, 204B, and 204C to interrupt the radio frequency fields emitted by surfaces 303A and 303B of inductive proximity switches 222A and 222B respectively is shown in greater detail in FIGS. 8, 9, and 10 for one direction of movement of target element 204 in the flagging apparatus according to this invention. Target element 204 is shown in a central neutral position in FIG. 8 with target faces 204A, 204B and 204C not engaging the radio frequency fields, shown by curved dashed lines, emitted by surfaces 303A and 303B of switches 222A and 222B, respectively. As the target element 204 rotates in a clockwise direction as shown in FIGS. 9 and 20, target faces 204A, 204B and 204C move in a curved path in front surfaces 303A and 303B at a small distance from these surfaces. During this movement the leading edge of target face 204A interrupts the radio frequency field emitted by surface 303B before any interruption of the radio frequency field emitted by surface 303A occurs, as shown in FIG. 9. Continued rotation of target element 204 causes target face 204A to penetrate further into the zone of the radio frequency field of surface 303B and the leading edge of target face 204B to interrupt the radio frequency field emitted by surface 303A as shown in FIG. 10. Now the radio frequency fields of surfaces 303A and 303B have been interrupted sequentially by the proper spacing between target faces 204A, 204B and 204C.

The inductive proximity switch described in respect to the drawings generates an electrical signal in response to the interruption of the induced alternating radio frequency field of the switch. That signal in turn in used as an indicator of the attainment of a predetermined position in the work space by the workpiece to operate, control the operation of or generate a command for the operation or control of the operation of machine elements in the practice of this invention. Various types of non-contact proximity switches emitting a directional energy field and producing a signal in response to an induced change in the field may be used in the practice of this invention. Thus, for example, non-contacting proximity switches emitting directional light, magnetic or high frequency sound fields may be used with target elements having target faces that absorb or reflect such energy to alter the condition of the field which in turn generates an electrical signal indicating the altered condition of the field.

Preferably, in the practice of this invention, an adjusting means such as 227 in FIGS. 2 and 3 is provided for laterally moving the proximity switch to adjust the position of the switch relative to the target face of the target element. Referring to FIGS. 2 and 3, there is shown an adjusting means comprising a knob 229 attached to a screw shaft 228 threaded into side bar 225 and in turn rests in slot 308 of switch block 214. Advantageously, turning knob 229 moves switch block 214 horizontally (1) to accurately position surfaces 303A and 303B of switches 222A and 222B respectively, so that in the central neutral position target faces 204A, 204B and 204C do not interrupt the radio frequency fields emitted by surfaces 303A and 303B, or (2) to laterally adjust the position of surfaces 303A and 303B so that probe 305 may be displaced a greater or lesser amount and thus the rotation of target element 204 increased or decreased before the longitudinal movement of the workpiece is stopped in response to a signal from switch 222A generated as a result of the interruption of radio frequency field emitted by surface 303A. The further movement of the workpiece in the work space, as a result of the greater displacement of the probe, positions the workpiece in a slightly different location in the work space with relation to a grinding wheel that result in a slightly increased stock removal from the workpiece during grinding. Thus, for example, if upon insertion, location and grinding of a workpiece in the grinder it is determined that insufficient stock was removed from the workpiece this condition may be corrected with the adjusting means on the flagging apparatus of this invention on subsequent workpieces by the use of the adjusting means to cause the flagging apparatus to position the workpiece in a new location in the work space to cause an increased removal of stock by the grinding wheel engaging the workpiece further into that portion of the workpiece to be ground. Conversely, if too much stock has been removed from a workpiece, the adjusting means may be used to adjust the flagging apparatus of this invention to position subsequent workpieces in a new location in the work space for decreased removal of stock by the grinding wheel.

The flagging apparatus of this invention may be mounted on an extending and retracting mount attached to a stationary member of a machine tool, for extending the flagging apparatus to position the probe in a predetermined location in the work space and for retracting the flagging apparatus back to withdraw the probe from the work space and store the flagging apparatus out of the way during the workpiece shaping (e.g. grinding) operation. Such extending and retracting mounts are well-known and commercially available. In one such known and commercially available mount, the flagging apparatus is attached to a rotatable forearm of the mount which is trunnioned in a bifurcated column rotatably mounted in a base dovetail connected to a stationary member of a machine tool for lateral adjustments. A hydraulic motor attached to the base of the mount is used to rotate the column and to operate a chain and sprocket drive, connected to the forearm, to rotate the forearm. Contacting mechanical type limit switches activated by the column are used for controlling the limits of extension and retraction of the mount. The motion of the forearm and column of the mount raise the flagging apparatus from a vertical stored position to a horizontal working position and lower the flagging apparatus from a horizontal working position to a stored vertical position. It is not always necessary to retract the flagging apparatus from its working position and the probe of the flagging apparatus may remain in contact with the workpiece during the shaping operation when the probe is provided with a tip made of a suitable material, e.g. tungsten carbide. When the probe of the flagging apparatus of this invention remains in contact with a workpiece surface that is shaped during the shaping operation (e.g. grinding operation) the flagging apparatus may also have a function of indicating the completion of the shaping operation.

What is claimed is:

1. A flagging apparatus, operable in either of two opposing directions without a required modification of the apparatus, for positioning a workpiece at a predetermined location in a work space in relation to a tool for shaping the workpiece by sensing off of a surface of the workpiece comprising (a) a body;

(b) at least one non-contacting, non-mechanical proximity switch emitting a directional energy field and generating a signal in response to an externally induced change in the field for indicating the position of the workpiece in the work space, said switch being in a field engageable, non-contacting orientation in respect to;

(c) a target element movable in either of two opposing directions having at least two target faces movable along a path through the energy field and interactive with the field, said target faces spaced apart from each other in a constant field interactive sequence relation, for inducing changes in the field; and (d) a probe attached to the target element for contacting a surface of the workpiece and activating the movement of the target element.

2. The apparatus according to claim 1 further including a movable means for carrying the proximity switch.

3. The apparatus according to claim 2 wherein the means is adjustable to set positions.

4. The apparatus according to claim 3 having two proximity switches.

5. The apparatus according to claim 4 wherein the two proximity switches are substantially in a side-by-side arrangement and emit an induced alternating radio frequency field from surfaces substantially facing the target faces in a direction toward the target face.

6. The apparatus of claim 5 wherein the target element has three target faces.

7. The combination comprising a machine having a movable workpiece carrying means for shaping a metal workpiece, and the flagging apparatus according to claim 1.

8. The combination according to claim 7 wherein the machine is a grinding machine.

9. The combination comprising a grinding machine for shaping a metal workpiece and a flagging apparatus according to claim 6.

* * * * *